US010711575B2

(12) United States Patent
Ejim et al.

(10) Patent No.: US 10,711,575 B2
(45) **Date of Patent: *Jul. 14, 2020**

(54) WELL DEBRIS HANDLING SYSTEM

(71) Applicant: Saudi Arabian Oil Company, Dhahran (SA)

(72) Inventors: Chidirim Enoch Ejim, Dhahran (SA); Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,259

(22) Filed: Mar. 22, 2019

(65) Prior Publication Data

US 2019/0218891 A1 Jul. 18, 2019

Related U.S. Application Data

(63) Continuation of application No. 15/691,345, filed on Aug. 30, 2017, now Pat. No. 10,287,853.

(51) Int. Cl.

| | |
|---|---|
| ***E21B 43/12*** | (2006.01) |
| ***E21B 41/00*** | (2006.01) |
| ***F01D 15/08*** | (2006.01) |
| ***F04D 13/08*** | (2006.01) |
| ***F04D 7/04*** | (2006.01) |
| *E21B 33/12* | (2006.01) |
| *B02C 18/00* | (2006.01) |

(52) U.S. Cl.

CPC ..... *E21B 41/00* (2013.01); *E21B 43/128* (2013.01); *F01D 15/08* (2013.01); *F04D 7/045* (2013.01); *F04D 13/08* (2013.01); *F04D 13/086* (2013.01); *B02C 18/0092* (2013.01); *E21B 33/12* (2013.01)

(58) Field of Classification Search

CPC ..... E21B 43/128

See application file for complete search history.

(56) References Cited

U.S. PATENT DOCUMENTS

| | | | | |
|---|---|---|---|---|
| 3,961,758 A | | 6/1976 | Morgan | |
| 4,226,475 A | * | 10/1980 | Frosch | E21C 25/60 134/17 |
| 6,361,272 B1 | | 3/2002 | Bassett | |
| 6,413,065 B1 | | 7/2002 | Dass | |
| 7,841,826 B1 | | 11/2010 | Phillips | |

(Continued)

FOREIGN PATENT DOCUMENTS

WO 2015034482 3/2015

OTHER PUBLICATIONS

International Search Report and Written Opinion issued in International Application No. PCT/US2018/048430 dated Dec. 19, 2018, 13 pages.

*Primary Examiner* — Giovanna C Wright

(74) *Attorney, Agent, or Firm* — Fish & Richardson P.C.

(57) ABSTRACT

A well tool assembly, system, and method for handling well debris is described. The assembly includes an electric submersible pump (ESP) configured to be positioned within a wellbore and a well debris cutting tool configured to be positioned downhole relative to the ESP within the wellbore. The ESP is configured to rotate in a first direction to pump well fluid in an uphole direction. The well debris cutting tool is configured to rotate in a second direction opposite the first direction and to grind debris carried by the well fluid in the uphole direction.

14 Claims, 5 Drawing Sheets

(56) References Cited

U.S. PATENT DOCUMENTS

| | | | | |
|---|---|---|---|---|
| 8,419,398 | B2 | 4/2013 | Kothnur et al. | |
| 8,936,430 | B2 | 1/2015 | Bassett | |
| 10,287,853 | B2 * | 5/2019 | Ejim | E21B 41/00 |
| 2005/0098349 | A1 | 5/2005 | Krueger et al. | |
| 2011/0203848 | A1 | 8/2011 | Krueger et al. | |
| 2017/0321695 | A1 * | 11/2017 | Head | F04C 13/008 |

* cited by examiner

100

WELL DEBRIS HANDLING SYSTEM

CROSS-REFERENCE TO RELATED APPLICATIONS

The present application is a continuation of and claims priority to U.S. application Ser. No. 15/691,345, filed Aug. 30, 2017. The entire contents of the application is incorporated herein by reference in its entirety.

TECHNICAL FIELD

This specification relates to handling well debris flowing with well fluids, for example, well fluids pumped in an uphole direction using electric submersible pumps (ESPs).

BACKGROUND

During hydrocarbon extraction, well fluid flowing from the hydrocarbon reservoir to the surface can include debris such as sand, foreign materials from previous well operations, small pieces of metallic or plastic material, or coating materials from sections of a well completion. If left unhandled, debris—especially large, hard, or sharp-edged debris—carried by the well fluid can cause erosion wear as the debris travels through or past well equipment. The debris can also plug or damage well equipment, which can potentially cause a catastrophic failure of a piece of equipment, such as an electric submersible pump, as it pumps well fluid uphole. Equipment failure can negatively impact production and can increase field asset operating costs. Taking measures to preserve and extend the life of well equipment is favorable to keep production economical.

SUMMARY

This specification describes technologies relating to handling well debris. This specification describes technologies relating to pumping well fluids in an uphole direction using an electric submersible pump (ESP) rotating in a direction and grinding debris carried by the well fluids using a well debris cutting cool rotating in the opposite direction.

Certain aspects of the subject matter described here can be implemented as a well tool assembly. The assembly includes an electric submersible pump (ESP) configured to be positioned within a wellbore and a well debris cutting tool configured to be positioned downhole relative to the ESP within the wellbore. The ESP is configured to rotate in a first direction to pump well fluid in an uphole direction. The well debris cutting tool is configured to rotate in a second direction opposite the first direction and to grind debris carried by the well fluid in the uphole direction.

This, and other aspects, can include one or more of the following features. The well debris cutting tool can include a turbine, a first cutting blade sub-assembly connected to and rotatable by the turbine, and a second cutting blade sub-assembly connected to and rotatable by the ESP. The turbine can be configured to be positioned within the wellbore, downhole relative to the ESP and to rotate in response to flow of the well fluid through the turbine in the uphole direction. The first cutting blade assembly can be configured to grind the debris in response to being rotated by the turbine. The second cutting blade sub-assembly can be uphole relative to the first cutting blade sub-assembly and downhole relative to the ESP. The second cutting blade sub-assembly can be configured to grind the debris in response to being rotated by the ESP.

The first cutting blade sub-assembly can be configured to counter-rotate relative to the second cutting blade sub-assembly.

The well debris cutting tool can include an annular housing configured to be positioned within the wellbore, downhole relative to the ESP. The turbine, the first cutting blade sub-assembly and the second cutting blade sub-assembly can be positioned within the annular housing.

The first cutting blade sub-assembly can include a cutter blade uphole relative to the turbine and downhole relative to the second cutting blade sub-assembly; and an inverted frusto-conical member comprising a first plurality of cutter profiles configured to grind the debris, where the cutter blade and the inverted frusto-conical member are rotatable by the turbine in the second direction.

The second cutting blade sub-assembly can define a plurality of annular grinding sections of decreasing grinding area in the uphole direction. The second cutting blade sub-assembly can be configured to grind the debris into decreasing sizes corresponding to the decreasing grinding area in the uphole direction in the plurality of annular grinding sections.

The second cutting blade sub-assembly can include a second plurality of cutter profiles positioned within an annulus formed by an inner wall of the annular housing and the inverted frusto-conical member. The first plurality of cutter profiles and the second plurality of cutter profiles can counter-rotate to grind the debris.

The inner wall of the annular housing can include a third plurality of cutter profiles configured to grind the debris.

The well debris cutting tool can include at least one discharge port on an uphole end of the well debris cutting tool. The at least one discharge port can be configured to flow ground debris in the uphole direction.

The at least one discharge port can be located on an axial cross-sectional surface of the well debris cutting tool or on a radial surface of the well debris cutting tool.

The well debris cutting tool can be configured to grind the debris to a size small enough to flow through the ESP without clogging the ESP.

Certain aspects of the subject matter described here can be implemented as a wellbore production system. The system includes an ESP configured to be positioned within a wellbore, a motor configured to be positioned within the wellbore, and a well debris cutting tool configured to be positioned within the wellbore. The ESP is configured to rotate to pump well fluid in an uphole direction. The motor is coupled to the pump and configured to provide power to rotate the ESP. The well debris cutting tool is configured to counter-rotate relative to the ESP and to grind debris carried by the well fluid in the uphole direction.

This, and other aspects, can include one or more of the following features. The well debris cutting tool can include a turbine configured to be positioned within the wellbore, a first cutting blade sub-assembly connected to and rotatable by the turbine, and a second cutting blade sub-assembly connected to and rotatable by the ESP. The turbine can be configured to rotate in response to flow of the well fluid through the turbine in the uphole direction. The turbine can be configured to counter-rotate relative to the ESP. The first cutting blade sub-assembly can be configured to grind the debris in response to being rotated by the turbine. The second cutting blade sub-assembly can be uphole relative to the first cutting blade sub-assembly and downhole relative to the ESP. The second cutting blade sub-assembly can be configured to grind the debris in response to being rotated by the ESP.

The motor can be configured to be positioned downhole relative to the ESP, and the well debris cutting tool can be configured to be positioned downhole relative to the motor.

The system can include a stinger coupled to and positioned downhole relative to the well debris cutting tool. The stinger can be configured to direct the well fluid to flow into the well debris cutting tool.

The system can include a packer positioned downhole relative to the well debris cutting tool. The packer can be configured to fluidically isolate a portion of the wellbore, downhole relative to the well debris cutting tool from a remainder of the wellbore, uphole relative to the well debris cutting tool. The system can include a pod positioned downhole relative to the ESP, and the pod can be configured to be coupled to the stinger and the packer. The pod can be configured to fluidically isolate an inner portion of the wellbore, uphole relative to the packer from a remaining outer portion of the wellbore, uphole relative to the packer.

The system can include a packer positioned downhole relative to the well debris cutting tool. The packer can be configured to couple to the stinger and to fluidically isolate a portion of the wellbore, downhole relative to the well debris cutting tool from a remainder of the wellbore, uphole relative to the well debris cutting tool.

The system can include a first protector configured to be positioned between the ESP and the motor, and a second protector configured to be positioned between the well debris cutting tool and the motor. The first protector can be configured to absorb a first portion of axial loads from the ESP. The second protector can be configured to absorb a second portion of axial loads from the debris cutting tool.

The ESP can include a thru-cabling cable deployed ESP (CDESP) positioned within the wellbore using a production tubing. The CDESP can be configured to be positioned downhole relative to the motor. The well debris cutting tool can be configured to be positioned downhole relative to the CDESP.

The system can include a first packer positioned nearer to a downhole end of the production tubing than an uphole end of the production tubing and a second packer positioned within the production tubing nearer to the downhole end than the uphold end. The first packer can be configured to seal a portion of the wellbore at or below the downhole end of and outside the production tubing from an external portion of the production tubing above the downhole end. The well debris cutting tool can be positioned downhole of the second packer. The second packer can be configured to direct the well fluid to flow through the well debris cutting tool and block the well fluid from flowing through a remainder of an internal portion of the production tubing.

Certain aspects of the subject matter described here can be implemented as a method. An ESP within a wellbore is rotated in a first direction to pump well fluid in an uphole direction. A well debris cutting tool positioned downhole relative to the ESP within the wellbore is rotated in a second direction opposite the first direction to grind debris carried by the well fluid in the uphole direction.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1:
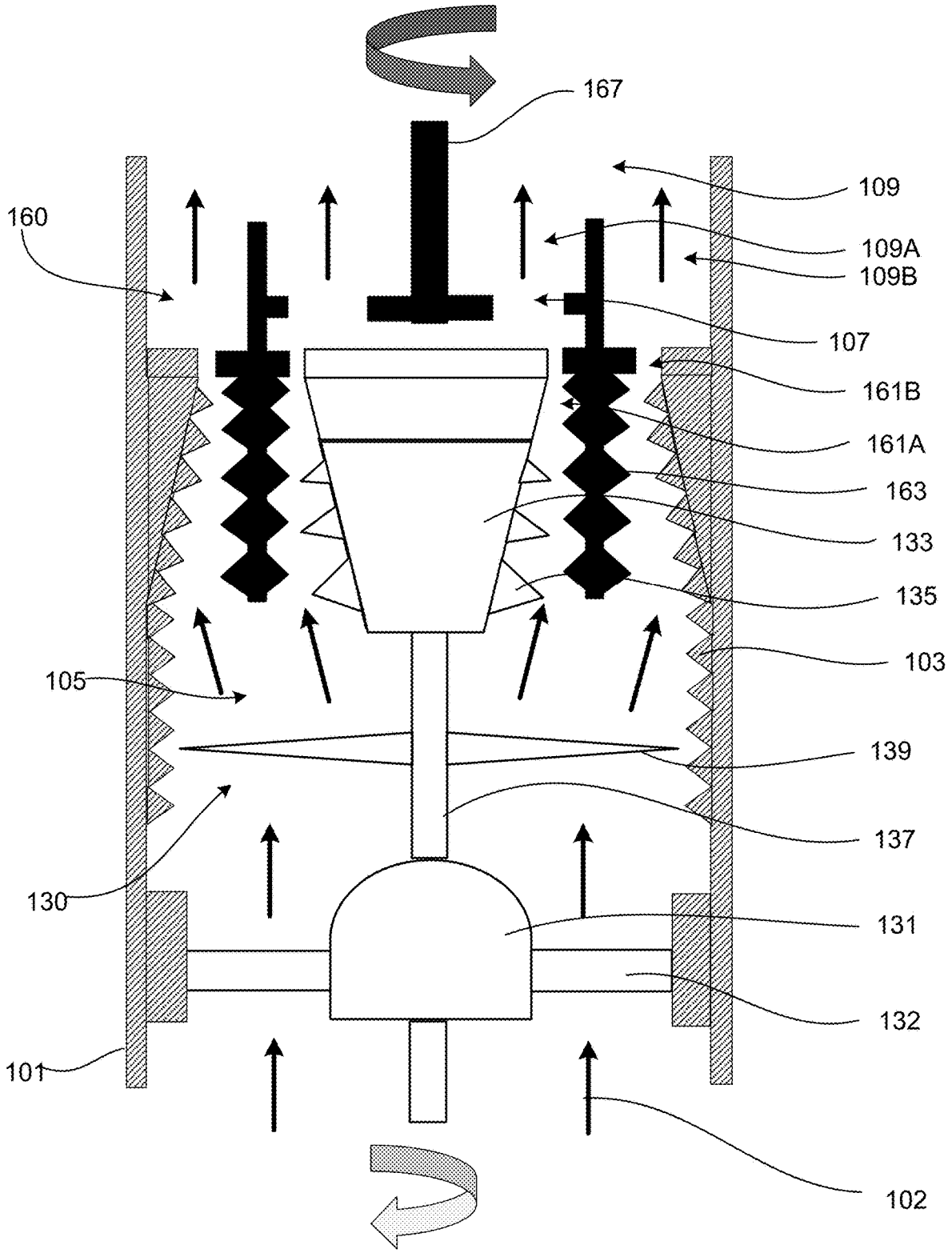
FIG. 1 is a diagram of an example of a debris cutting tool for an electric submersible pump (ESP), according to the present disclosure.

An electric submersible pump (ESP) is an artificial-left device for lifting a volume of fluid—for example, approximately 150 to 150,000 barrels per day (bpd)—from a wellbore. An ESP system can include a centrifugal pump, a protector, a power delivery cable, a motor, and surface controls. The pump can be used to transfer fluid from one location to another. The motor can provide mechanical power to drive the pump, and the power delivery cable can supply the motor with electrical power from the surface. The protector can absorb a thrust load from the pump, transmit power from the motor to the pump, equalize pressure, provide and receive additional motor oil as temperature fluctuates, and prevent well fluid from entering the motor. The pump can include multiple stages of impellers and diffusers. A rotating impeller can add kinetic energy to a fluid, and a stationary diffuser can convert the kinetic energy of the fluid from the impeller into head (or pressure). Pump stages can be stacked in series to form a multi-stage system that can be contained within a pump housing. In a multi-stage system, the head generated in each stage is summative. For example, the total head developed by a multi-stage system can increase linearly from the first to the last stage.

During hydrocarbon production utilizing ESPs, well fluid from a rock formation can flow into a wellbore and past the motor and protector and into the pump through a pump intake. The pump intake can include an intake screen to filter debris of a certain size that can be carried by the well fluid. The presence of debris in well fluid can cause erosion wear on the motor and the protector. The debris can affect structural integrity of various well equipment, and extended periods of filtering can result in blockage of the pump intake screen ports. The cumulative effect of blocked intake screen can cause flow to the pump to decrease and therefore reduce hydrocarbon production to the surface. In the case that the flow rate falls below a minimum flow rate for cooling the pump motor, the motor temperature can rise and result in motor burn out and subsequent ESP failure. At a certain point if the motor does not burn out and more debris continues to cover the intake screen, the intake screen can become blocked, such that no flow enters the ESP. In such a case, the intake screen walls can be subjected to a pressure equal to the corresponding static pressure at the intake setting depth, such as approximately 6000 pounds per square inch gauge (psig) or greater. Over time, this high pressure can cause the intake screen to collapse or cave in.

Screen collapse can allow large foreign materials into the pump, and in some cases can result in blockage of the impeller inlet. These failures can result in deferred production and can also lead to high field asset operating costs associated with well repair operations, such as rig workovers. Apparatuses, assemblies, and systems configured to be positioned in a wellbore can operate under high borehole pressures, such as approximately 6000 psig, and high wellbore temperatures, such as approximately 90 to 180 degrees Celsius.

A well debris cutting tool can be installed upstream of an ESP to grind, break apart, and shear debris carried by well fluid into smaller sizes that can pass through equipment, such as an ESP, without clogging. In this document, the term "grind" should be interpreted in a flexible manner to include any form of reducing a substance into smaller pieces, such as break apart or shear, and does not necessarily mean, for example, that the substance is pulverized into a powder. Particular implementations of the subject matter described in this specification can be implemented so as to realize one or more of the following advantages. Debris carried by well fluid during hydrocarbon production can be ground to smaller sizes due to the high cutting and shearing capability of counter-rotation. ESP operational life can be extended, and reliability can be improved, thereby reducing field operating costs and likelihood of deferred production.

FIG. 1 illustrates an example of a well debris cutting tool 100. The cutting tool 100 can include an annular housing 101, a turbine 131, a first cutting blade sub-assembly 130, and a second cutting blade sub-assembly 160. The inner wall of the housing 101 can include multiple housing cutter profiles 103 to grind debris. The turbine 131, the first blade sub-assembly 130, and the second blade sub-assembly 160 can be positioned within the housing 101. In certain implementations, the turbine 131 can be located in a separate unit with its own housing, such that the turbine 131 is installed on the pumping system. The turbine 131 can include turbine blades 132 and a turbine shaft 137. The first blade sub-assembly 130 can be mechanically coupled to the turbine 131, for example, by the turbine shaft 137. The first blade sub-assembly 130 can include a cutter blade 139 uphole relative to the turbine 131 and downhole relative to the second blade sub-assembly 160. In certain implementations, the cutter blade 139 can be located on the same radial plane as some teeth of the cutter profile 103 of the housing 101. The first blade sub-assembly 130 can include an inverted frusto-conical member 133 with multiple cutter profiles 135 to grind debris. The shape of the inverted frusto-conical member 133 causes the grinding area to decrease along the axial length of the cutting tool 100, which can correspond to decreasing debris size as the debris travels through the tool 100. The space between the housing 101 and the first blade sub-assembly 130 can form an annulus 105. The debris cutting tool 100 can have a radial or axial intake to receive debris-carrying well fluid 102.

The second blade sub-assembly 160 can include multiple cutter profiles 163 and can be positioned within the annulus 105 formed by the inner wall of the housing 101 and the inverted frusto-conical member 133 of the first blade sub-assembly 130. Although the debris cutting tool 100 is not adjacent to the ESP 201 shown in FIGS. 2A and 2B, the second blade sub-assembly 160 of the debris cutting tool 100 can be mechanically coupled to and rotate with the ESP 201, for example, by a pump shaft 167 which also rotates the pump impellers (not shown). The space between the first blade sub-assembly 130 and the second blade sub-assembly can form a grinding section 161A. The space between the second blade sub-assembly and the housing 101 can form another grinding section 161B. The cutter profiles (103, 135, 163) can extend into the grinding sections (161A, 161B), which can further create a decrease in grinding area in the axial direction of the cutting tool 100. In the example shown in FIG. 1, a portion of the cutter profile 103 on the inner wall of the housing 101 that overlaps with the frusto-conical member 133 or the cutter profile 163 can extend radially inward along the axially uphole direction. The cutter profiles (103, 135, 163) can have various sizes, shapes, and patterns. As shown in FIG. 1, the cutter profiles (103, 135, 163) include teeth; the base of the cutter teeth profile can be wide enough to withstand cutting and grinding forces and loads. For example, the base of the cutter teeth profile can be on the order of 1 inch. The size of the base of the cutter teeth profile can depend on the size and amount of debris to be handled by the tool 100. The radial width of the teeth of the cutter profiles (103, 135, 163) can be equal along the axial length of the tool 100. In alternative implementations, the cutter profiles (103, 135, 163) can have increasing radial width along the axial length of the cutting tool 100, and the inverted frusto-conical member 133 can have a constant diameter, like a cylinder, such that the grinding area still decreases along the axial length of the cutting tool 100.

The debris cutting tool 100 can be of a bolt-on type or integral to the ESP 201. The debris cutting tool 100 can include a single stage or multiple stages. A multi-stage type debris cutting tool (not shown) can be configured such that subsequent stages are equipped to handle progressively smaller sizes of debris. The debris cutting tool 100 can include elements that are hardened and strong enough to withstand abrasion, erosion, and the hydraulic loading from foreign materials (debris) being broken down into smaller sizes, with adequate radial bearings used for shaft stability.

The ESP 201 can be positioned within a wellbore and rotate—that is, its motor can be driven to rotate its impellers—in order to pump well fluid 102 in an uphole direction. As the ESP 201 is operating, well fluid 102 can flow in an uphole direction through the debris cutting tool 100, which can be positioned downhole relative to the ESP 201 within the wellbore and configured to rotate in an opposite direction of the ESP 201 and grind debris carried by the well fluid 102 in the uphole direction. The turbine 131 can be configured to rotate in response to the flow of the well fluid 102 through the turbine 131 in the uphole direction. Fluid flow past the turbine blades 132 can cause the turbine blades 132, and consequently the turbine 131, to rotate. The first blade sub-assembly 130, which includes the cutter blade 139 and the inverted frusto-conical member 133, can be connected to the turbine 131 by the turbine shaft 137 and can be rotated by the turbine 131 in the same direction as the turbine 131.

In response to being rotated by the turbine, the first blade sub-assembly 130 can grind debris carried by the fluid flowing that caused the turbine blades 132 to rotate. The second blade sub-assembly 160 can be connected to the ESP 201 by the pump shaft 167 and can be rotated by the ESP 201 in the same direction as the ESP 201. In response to being rotated by the ESP 201, the second blade sub-assembly 160 can grind debris carried by the fluid past the turbine blades 132. The turbine blades 132 can be configured to rotate the turbine 131 in an opposite direction of the ESP 201. Consequently, the first blade sub-assembly 130 (connected to the turbine 131) can counter-rotate relative to the second blade sub-assembly 160 (connected to the ESP 201). Furthermore, the cutter profiles 135 of the first blade sub-assembly 130 and the cutter profiles 163 of the second blade sub-assembly 160 can counter-rotate to grind debris.

Well fluid 102 can carry various amounts and sizes of debris. The well fluid 102 mixed with debris can flow uphole into an intake area of the turbine 131. As the well fluid 102 passes through the turbine 131, the well fluid 102 can come in contact with the turbine blades 132 and cause the blades 132 to rotate. As mentioned, the blades 132 can be configured to rotate in a direction opposite that of the ESP 201. The spinning blades 132 can also cause rotation of the cutter blades 139 and the first blade sub-assembly 130 because they are connected by the turbine shaft 137. As the well fluid 102 travels uphole through the debris cutting tool 100, the fluid 102 can come in contact with the cutter blades 139, which apply shearing and cutting to reduce debris into smaller sizes. The cutter blades 139 can also provide centrifugal force to the debris in the well fluid 102, so that the debris can move radially outwards toward the cutter profiles 103 of the housing 101, where the debris size can be further reduced as the debris comes into contact with the cutter profiles 103. The well fluid 102 traveling uphole can carry a portion of the debris to the grinding section 161A between the first blade sub-assembly 130 and the second blade sub-assembly 160 and a portion of the debris to the grinding section 161B between the second blade sub-assembly 160 and the housing 101. In certain implementations, the well debris cutting tool 100 can be configured to pass a majority of the well fluid 102 (and accompanying debris) through the grinding section 161A, which is the counter-rotating section.

Because the first blade sub-assembly 130 and the second blade sub-assembly 160 counter-rotate, the objects (well fluid 102 with debris) within the annular gap (grinding section 161A) between the sub-assemblies (130, 160) can experience a resultant angular momentum that is higher than the individual, respective momentum of each sub-assembly (130, 160). This higher resultant angular momentum can be associated with higher torque and power, which can grind debris within an annulus and reduce debris to smaller sizes. The cutter profiles (103, 135, 163) can be made of abrasion resistant and corrosion resistant materials, such as polycrystalline diamond compact (PDC), and can form multiple annular grinding sections (161A, 161B) of decreasing grinding area in the direction of well fluid 102 flow, for example, in the uphole direction. The annular grinding sections (161A, 161B) can grind debris into decreasing sizes, corresponding to the decreasing grinding area in the uphole direction. The debris cutting tool 100 can grind the debris carried in the well fluid 102 to a size small enough to flow through the ESP 201 without clogging the ESP 201.

A portion of the well fluid 102 and accompanying debris can travel uphole from the grinding section 161A to a discharge section 109A through a discharge port 107. The discharge port 107 can be located on an uphole end of the tool 100, which allows ground debris to flow in the uphole direction. The discharge port 107 can be located on an axial cross-sectional surface of the tool 100 (as shown in FIG. 1) or on a radial surface of the tool 100. The debris cutting tool 100 can optionally include additional discharge ports. Another portion of the well fluid 102 and accompanying debris can travel uphole from the grinding section 161B to a discharge section 109B. The discharge sections (109A, 109B) can combine into a discharge section 109 at a point uphole (that is, after some axial distance) of the discharge port 107, so that the portion of well fluid 102 in the discharge section 109A and the portion of well fluid 102 in the discharge section 109B can mix and combine. The axial spacing of the combined discharge section 109 can be long enough for the well fluid 102 flow to be swirl-free before exiting the debris cutting tool 100 and entering another component, such as the ESP 201. The debris cutting tool 100 can optionally include additional discharge ports. In certain implementations, the debris cutting tool 100 can include a discharge port on the housing 101 that allows well fluid 102 and accompanying debris to exit the tool 100 radially.

Figure 2A:
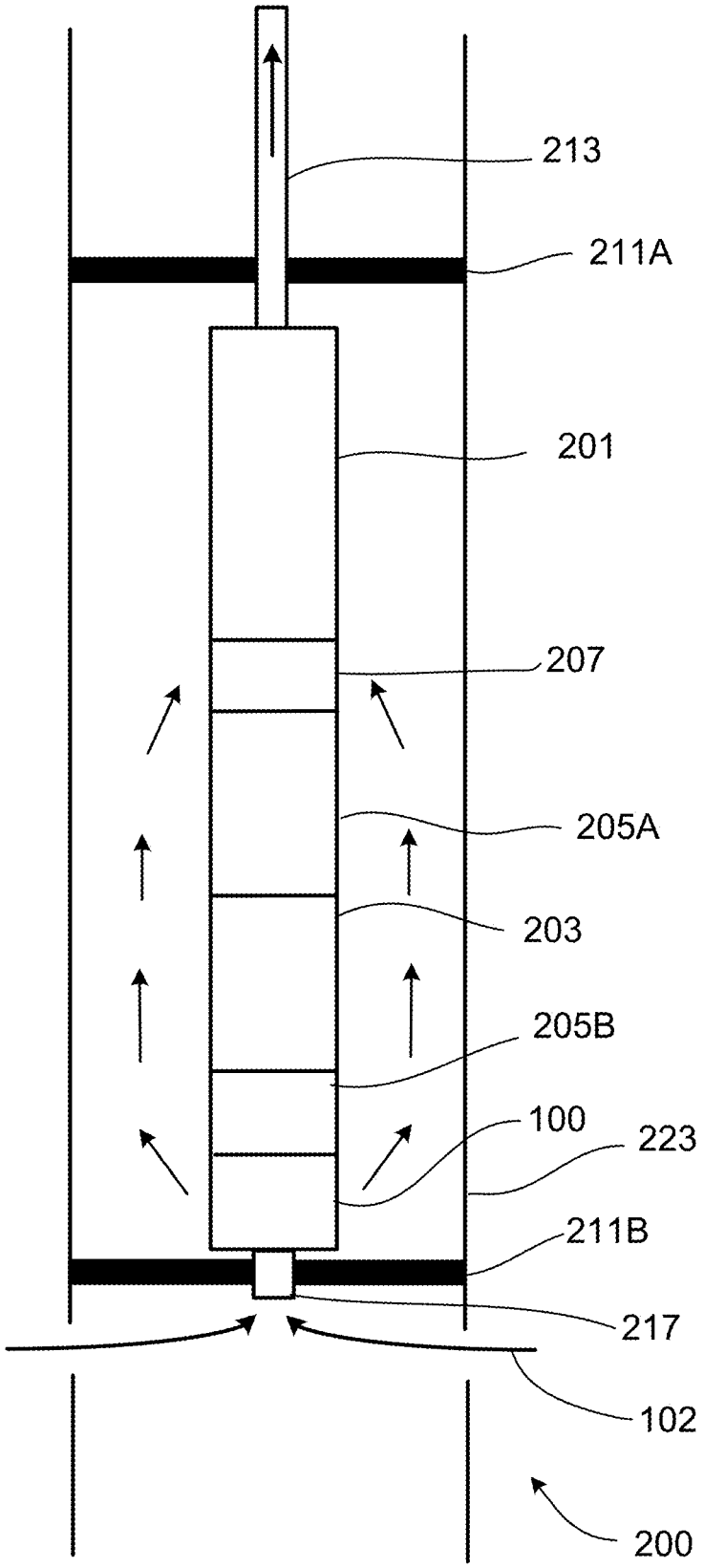
FIG. 2A is a diagram of an example of a wellbore production system with a debris cutting tool, according to the present disclosure.
Figure 2B:
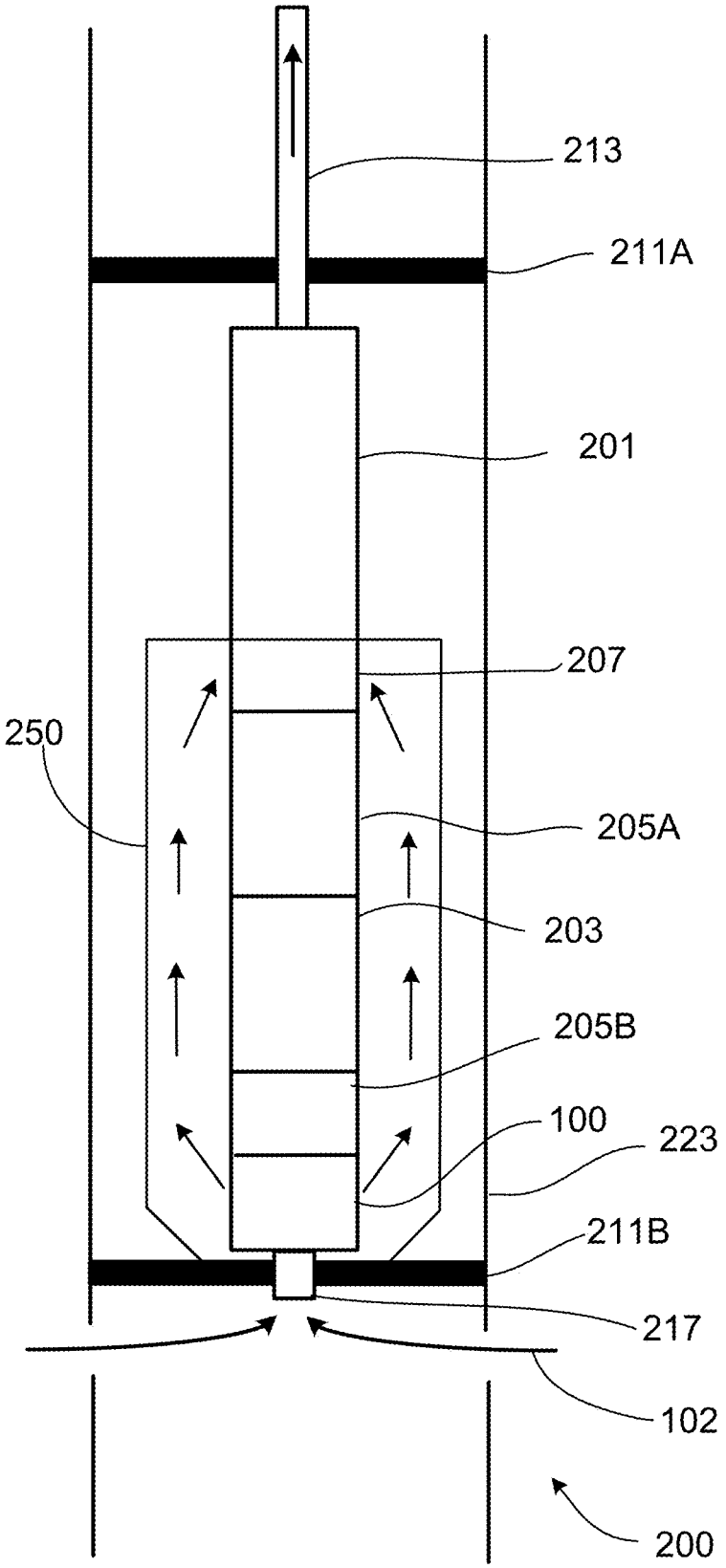
FIG. 2B is a diagram of an example of a wellbore production system with a debris cutting tool, according to the present disclosure.
Figure 3:
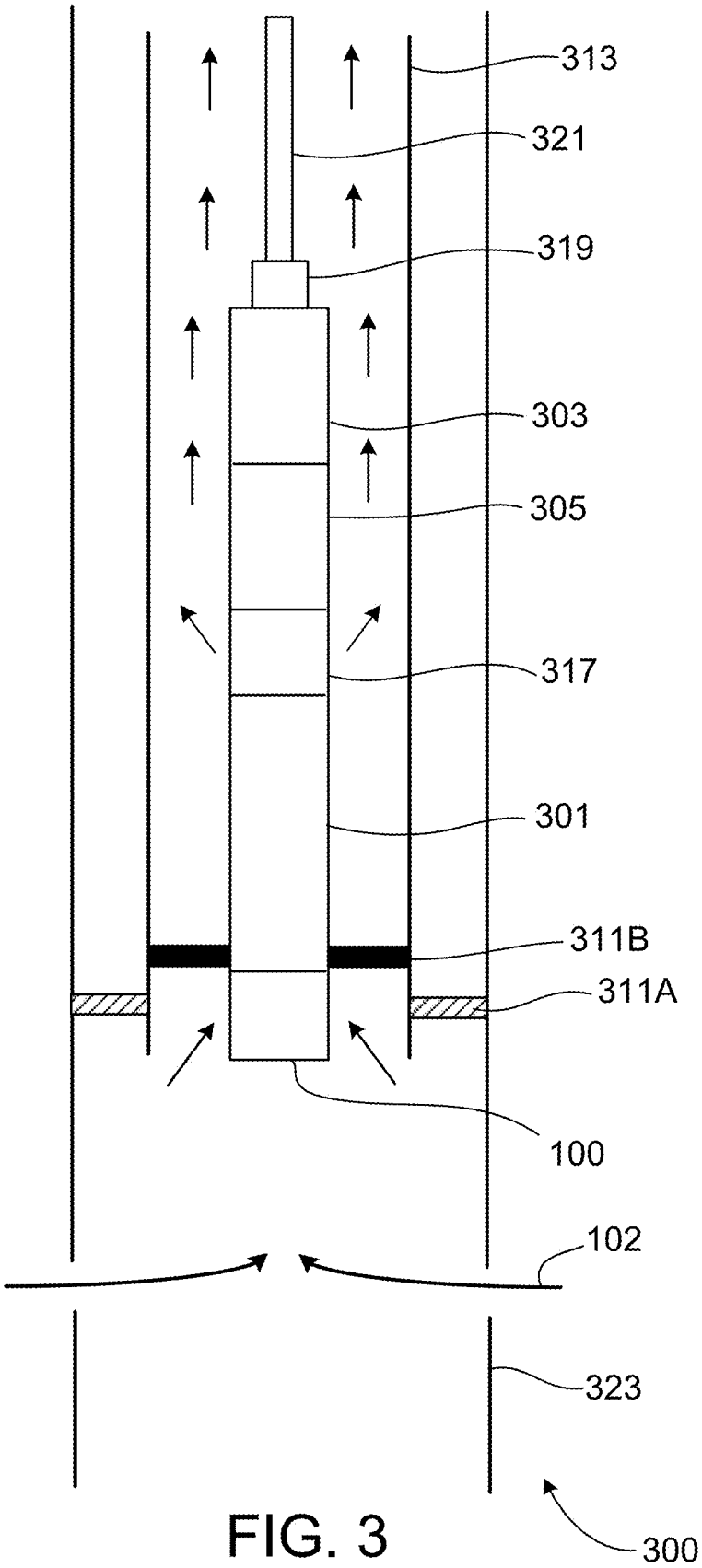
FIG. 3 is a diagram of an example of a wellbore production system with a debris cutting tool, according to the present disclosure.

FIG. 2A illustrates an example of a wellbore production system 200A installed with a well debris cutting tool (for example, the cutting tool 100 described with reference to FIG. 1). The production system 200A can include a casing 223, a packer 211A, production tubing 213, an ESP 201, a pump intake 207, a protector 205A, and a motor 203. The various components of the production system 200A can have the same outer diameter. In certain implementations, the components of the production system 200A can have different diameters, but all components can be designed to handle a desired flow of well fluid 102. In the particular examples described in this specification, the pump, such as the ESP 201, lifts well fluid 102 in an uphole direction, so the term upstream refers to a direction relatively downhole, and the term downstream refers to a direction relatively uphole. As shown in FIGS. 2A and 2B, the motor 203 can be positioned upstream (downhole) to the ESP 201. The order of components of a wellbore production system can vary (an example is shown in FIG. 3), but the intake 207 is located upstream of the ESP 201, and the protector 205A is typically located adjacent to the motor 203. For example, the protector 205A can be positioned between the ESP 201 and the motor 203 and can absorb a portion of axial loads from the ESP 201 lifting the well fluid 102.

Well fluid 102 which can carry debris can flow from a reservoir and enter the casing 223 through perforations or other openings and travel in an uphole direction. The packer 211A can be positioned downstream (uphole) relative to the ESP 201 and can fluidically isolate a portion of the wellbore upstream (downhole) relative to the ESP 201 from a remainder of the wellbore downstream (uphole) relative to the ESP 201. For example, the packer 211A can be positioned to isolate the reservoir, such that any fluid from the reservoir first flows through the ESP 201 before entering the production tubing 213 and traveling further downstream. The pump intake 207 can include a screen to filter debris before fluid enters the ESP 201. The motor 203 can be a center-tandem (CT) motor or other suitable motor. The production system 200A can include additional components, such as downhole sensors, for example, for pressure, temperature, flow rate, or vibration; additional packers; wellheads; centralizers or protectorlizers; check valves; motor shroud or recirculation systems; additional screens or filters; or a bypass, for example, a Y-tool.

The production system 200A can include additional components. For example, the production system 200A can also include a secondary packer 211B, a secondary protector 205B, a stinger 217, and a well debris cutting tool, such as the debris cutting tool 100. The wellbore production system 200A, including the ESP 201, the motor 203, and the well debris cutting tool 100, can be positioned within a wellbore. As shown in FIGS. 2A and 2B, the well debris cutting tool 100 can be positioned upstream (downhole) relative to the motor 203. The ESP 201 can rotate to pump well fluid in an uphole direction, and the motor 203 can be coupled to the ESP 201 and provide power to rotate the ESP 201. The well debris cutting tool 100 can counter-rotate relative to the ESP 201 and grind debris carried by the well fluid 102 in the uphole direction. The secondary packer 211B can be positioned upstream (downhole) to the debris cutting tool 100 and can fluidically isolate a portion of the wellbore upstream (downhole) relative to the debris cutting tool 100 from a remainder of the wellbore downstream (uphole) relative to the debris cutting tool 100. The secondary packer 211B can also be coupled to the stinger 217 and can fluidically isolate a portion of the wellbore upstream (downhole) relative to the debris cutting tool 100 from a remainder of the wellbore downstream (uphole) relative to the debris cutting tool 100. For example, the packer 211B can be positioned to isolate the reservoir, such that any fluid from the reservoir first flows through the stinger 217 and the debris cutting tool 100 before entering the ESP 201.

The stinger 217 can be a section of tubing and can direct well fluid 102 to flow from the wellbore into the debris cutting tool 100. In certain implementations, the stinger 217 can be considered to have a similar function for the debris cutting tool 100 as the pump intake 207 has for the ESP 201. The stinger 217 can be coupled to and positioned upstream (downhole) relative to the debris cutting tool 100. The debris cutting tool 100 can, for example, have an axial intake and a radial discharge, as shown for systems 200A and 200B in FIGS. 2A and 2B, respectively. The debris cutting tool 100 can be connected to the stinger 217, which can be attached to and sealed by the secondary packer 211B. The debris cutting tool 100 and the stinger 217 can have the same outer diameter or different outer diameters, depending on desired flow rate. The secondary protector 205B can be positioned between the debris cutting tool 100 and the motor 203 and can absorb a second portion of axial loads from the debris cutting tool 100 handling the well fluid 102. The secondary protector 205B can take up thrust and shaft loads coming from the debris cutting tool 100 and prevent the loads from being transmitted to the motor 203.

Well fluid 102 which can carry foreign material such as debris can flow from the reservoir and enter a bore of the stinger 217 and downstream to the debris cutting tool 100. The debris cutting tool 100 can substantially grind the debris, such that the smaller-sized debris blends thoroughly with the well fluid 102, and the well fluid 102 (and accompanying debris) can be ejected through the radial discharge ports of the tool 100 into an annulus downstream (or relatively uphole) of the secondary packer 211B. The well fluid 102 can flow past the motor 203 and the protectors (205A, 205B), and this flow of well fluid 102 can additionally provide cooling to the motor 203. The debris-carrying well fluid 102 can flow into the pump intake 207. The intake 207 can include a screen, but may not be necessary due to the debris cutting tool 100. Downstream (or relatively uphole) of the intake 207, the well fluid 102 can flow through the vanes (or impellers) of the ESP 201. The ESP 201 can pressurize the well fluid 102 in order to lift the well fluid 102 to the surface through the production tubing 213. At the surface, the debris-carrying well fluid 102 can be treated to separate the well fluid 102 from the debris.

FIG. 2B illustrates an example of a wellbore production system 200B installed with a well debris cutting tool (for example, the cutting tool 100 described with reference to FIG. 1). The production system 200B is substantially the same as 200A but can include additional components. In certain implementations, the production system 200B can include a pod 250 that isolates the debris cutting tool 100 from an internal portion of the casing 223 uphole of the secondary packer 211B. The pod 250 can also enclose and isolate the pump intake 207, the protectors 205A and 205B, the motor 203, and the stinger 217 from the internal portion of the casing uphole of the secondary packer 211B. In certain implementations, the packer 211A may not be included. In such implementations, the packer 211B can be positioned downhole relative to the well debris cutting tool 100 and fluidically isolate a portion of the wellbore, downhole relative to the well debris cutting tool 100 from a remainder of the wellbore, uphole relative to the well debris cutting tool 100. The pod 250 can be positioned downhole relative to the ESP 201. The pod 250 can couple to the stinger 217 and the packer 211B, and the pod 250 can fluidically isolate an inner portion of the wellbore, uphole relative to the packer 211B from a remaining outer portion of the wellbore, uphole relative to the packer 211B.

Well fluid 102 which can carry foreign material such as debris can flow from the reservoir and enter a bore of the stinger 217 and downstream to the debris cutting tool 100. In certain implementations, the well fluid 102 enters the debris cutting tool 100 axially through the stinger 217. The debris cutting tool 100 can substantially grind the debris, such that the smaller-sized debris blends thoroughly with the well fluid 102, and the well fluid 102 (and accompanying debris) can be ejected through the radial discharge ports of the tool 100 into an annulus of the pod 250. The well fluid 102 can flow past the motor 203 and the protectors (205A, 205B), and this flow of well fluid 102 can additionally provide cooling to the motor 203. The debris-carrying well fluid 102 can flow into the pump intake 207. In certain implementations, the pump intake 207 allows well fluid 102 to enter radially. The intake 207 can include a screen, but may not be necessary due to the debris cutting tool 100. Relatively uphole of the intake 207, the well fluid 102 can flow through the vanes (or impellers) of the ESP 201. The ESP 201 can pressurize the well fluid 102 in order to lift the well fluid 102 to the surface through the production tubing 213. At the surface, the debris-carrying well fluid 102 can be treated to separate the well fluid 102 from the debris.

FIG. 3 illustrates an example of a wellbore production system 300 installed with a well debris cutting tool, for example, the cutting tool 100. The production system 300 can include a casing 323, an outer packer 311A, production tubing 313, an inner packer 311B, a power cable 321, an adapter 319, a motor 303, a protector 305, a pump discharge 317, a thru-tubing cable deployed electric submersible pump (CDESP) 301, and a well debris cutting tool, such as the debris cutting tool 100. The CDESP 301 can be positioned within the wellbore using the production tubing 313. Various components of the production system 300 can have the same or different outer diameters, but all components can be designed to handle a desired flow of well fluid 102. In the particular examples described in this specification, the pump, such as the CDESP 301, lifts well fluid 102 in an uphole direction, so the term upstream refers to a direction relatively downhole, and the term downstream refers to a direction relatively uphole. The order of components of a wellbore production system can vary, but the protector 305 is typically located adjacent to the motor 303. In contrast to the systems 200A and 200B shown in FIGS. 2A and 2B, respectively, the CDESP 301 of the production system 300 can be positioned upstream (that is, downhole) relative to the motor 303. The components of the production system 300 can be supported by the power cable 321, which can also supply electrical power to the motor 303 through the adapter 319.

Well fluid 102 which can carry debris can flow from a reservoir and enter the casing 323 through perforations or other openings and travel in an uphole direction. The outer (first) packer 311A can be positioned nearer to an upstream (downhole) end of the production tubing 313 than a downstream (uphole) end of the production tubing 313 and can seal a portion of the wellbore at or below the upstream (downhole) end of and outside the production tubing 313 from an external portion of the production tubing 313 above the upstream (downhole) end. The inner (second) packer 311B can be positioned within the production tubing 313 nearer to the upstream (downhole) end than the downstream (uphole) end and can direct the well fluid 102 to flow through the debris cutting tool 100, which can be positioned upstream (downhole) of the inner (second) packer 311B. The inner (second) packer 311B can block the well fluid 102 from flowing through a remainder of an internal portion of the production tubing 313. For example, the packers (311A, 311B) can isolate the reservoir, such that any fluid from the reservoir first flows through the debris cutting tool 100 before entering the CDESP 301 and traveling further downstream through the production tubing 313 annulus and ultimately to the surface. The motor 303 can be a center-tandem (CT) motor or other suitable motor. In certain implementations, the production system 300 can include a pump intake (not shown) that can include a screen to filter debris before fluid enters the CDESP 301. The production system 300 can include additional components, such as downhole sensors, for example, for pressure, temperature, flow rate, or vibration; additional packers; wellheads; centralizers or protectorlizers; check valves; motor shroud or recirculation systems; additional screens or filters; or a bypass, for example, a Y-tool.

The wellbore production system 300, including the CDESP 301, the motor 303, and the well debris cutting tool 100, can be positioned within a wellbore. As shown in FIG. 3, the well debris cutting tool 100 can be positioned upstream (downhole) relative to the motor 303. The CDESP 301 can rotate to pump well fluid in an uphole direction, and the motor 303 can provide power to rotate the CDESP 301. The well debris cutting tool 100 can counter-rotate relative to the CDESP 301 and grind debris carried by the well fluid 102 in the uphole direction. The debris cutting tool 100 can be positioned upstream (downhole) relative to the CDESP 301 and can, for example, have a radial intake and an axial discharge. In alternative implementations, the CDESP 301 can have an axial intake and an axial discharge.

Well fluid 102 which can carry foreign material such as debris can flow from the reservoir and enter the debris cutting tool 100. The debris cutting tool 100 can substantially grind the debris, such that the smaller-sized debris blends thoroughly with the well fluid 102, and the well fluid 102 (and accompanying debris) can be ejected through the axial discharge ports of the tool 100 into the CDESP 301. The well fluid 102 can flow through the vanes (or impellers) of the CDESP 301, and the CDESP 301 can pressurize the well fluid 102 in order to lift the well fluid 102 to the surface through the production tubing 313. The well fluid 102 can radially exit the CDESP 301 through the pump discharge 317 and can flow past the motor 303 and the protector 305. The flow of well fluid 102 past the motor can additionally provide cooling to the motor 303. At the surface, the debris-carrying well fluid 102 can be treated to separate the well fluid 102 from the debris.

Figure 4:
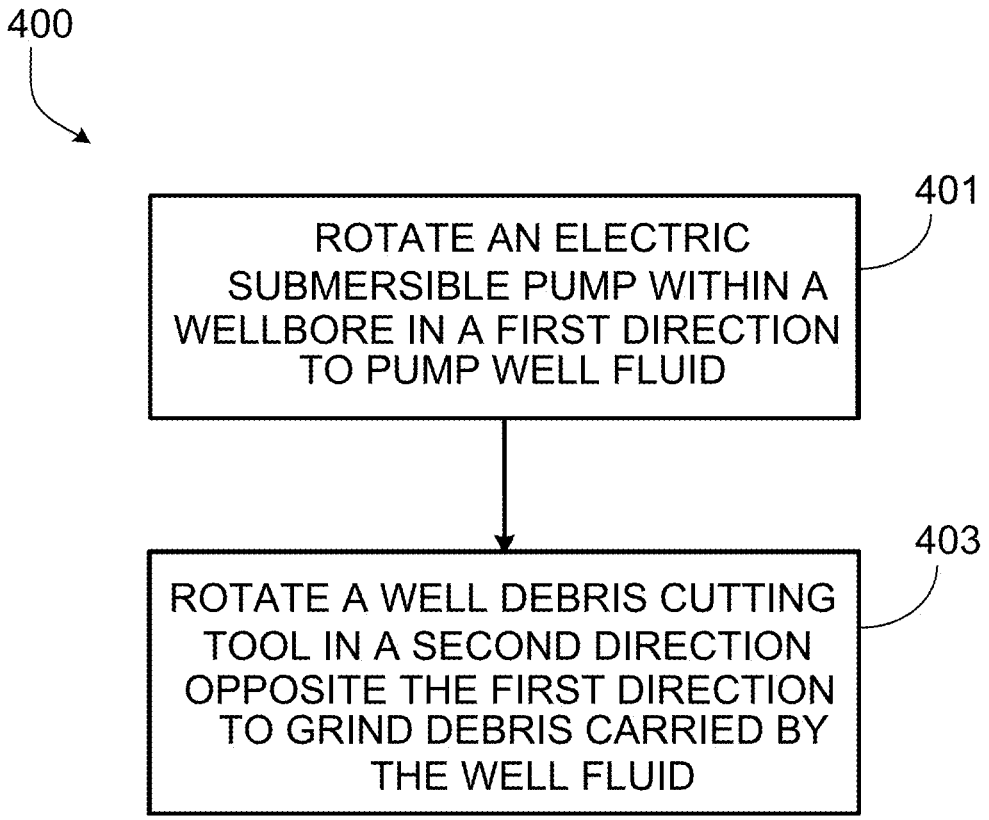
FIG. 4 is a flow chart of an example of a method for rotating a debris cutting tool in an opposite direction of an ESP, according to the present disclosure.

FIG. 4 is a flow chart of an example of a method 400 for rotating a debris cutting tool, such as the well debris cutting tool 100, in an opposite direction of an ESP, such as ESP 201 or CDESP 301. At 401, an ESP is rotated within a wellbore in a first direction in order to pump well fluid in an uphole direction. The motor of the ESP can be driven such that the impellers of the ESP are rotated in the first direction. At 403, a well debris cutting tool, such as the well debris cutting tool 100, positioned downhole relative to the ESP 201 within the wellbore is rotated in a second direction opposite the first direction to grind debris that is carried by the well fluid in the uphole direction. The well debris cutting tool can include a hydraulically-driven device, such as a turbine 131, that can rotate in the second direction opposite the first direction in response to fluid flowing through the device. The counter-rotation of the well debris cutting tool and pump can result in grinding the debris carried by the well fluid into a smaller size.

According to Newton's Second Law of Motion (applied to a rotary system), the rate of change of angular momentum of a rotating body results in a torque in the direction of rotation. From vector addition, for momenta in opposite directions, the resultant momentum is approximately the sum of the individual momentum. When two co-axial bodies with one enclosed within the other are counter-rotating, the direction of each respective angular momentum is also counter-rotating. Because the debris cutting tool 100 and the ESP 201 (or CDESP 301) counter-rotate, the objects (such as debris-carrying well fluid 102) between them can experience a resultant angular momentum that is higher than the individual, respective momentum of each (the debris cutting tool or the ESP). This higher resultant angular momentum can be associated with higher torque and power, which can grind debris within an annulus and reduce debris to smaller sizes in comparison to a uni-directional rotating system.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A wellbore production system comprising:

an electric submersible pump (ESP) configured to be positioned within a wellbore, the ESP configured to rotate to pump well fluid in an uphole direction;

a motor configured to be positioned within the wellbore downhole relative to the ESP, the motor coupled to the ESP and configured to provide power to rotate the ESP; and a well debris cutting tool configured to be positioned within the wellbore downhole relative to the motor, the well debris cutting tool configured to counter-rotate relative to the ESP, the well debris cutting tool configured to grind debris carried by the well fluid in the uphole direction.

2. The system of claim 1, further comprising a stinger coupled to and positioned downhole relative to the well debris cutting tool, the stinger configured to direct the well fluid to flow into the well debris cutting tool.

3. The system of claim 2, further comprising:

a packer positioned downhole relative to the well debris cutting tool, the packer configured to fluidically isolate a portion of the wellbore, downhole relative to the well debris cutting tool from a remainder of the wellbore, uphole relative to the well debris cutting tool; and a pod positioned downhole relative to the ESP, the pod configured to couple to the stinger and the packer and to fluidically isolate an inner portion of the wellbore, uphole relative to the packer from a remaining outer portion of the wellbore, uphole relative to the packer.

4. The system of claim 2, further comprising a packer positioned downhole relative to the well debris cutting tool, the packer configured to couple to the stinger and to fluidically isolate a portion of the wellbore, downhole relative to the well debris cutting tool from a remainder of the wellbore, uphole relative to the well debris cutting tool.

5. The system of claim 1, further comprising:

a first protector configured to be positioned between the ESP and the motor, the first protector configured to absorb a first portion of axial loads from the ESP; and a second protector configured to be positioned between the well debris cutting tool and the motor, the second protector configured to absorb a second portion of axial loads from the debris cutting tool.

6. The system of claim 1, wherein the ESP comprises a thru-tubing cable deployed ESP (CDESP) positioned within the wellbore using a production tubing, and wherein the CDESP is configured to be positioned downhole relative to the motor, and wherein the well debris cutting tool is configured to be positioned downhole relative to the CDESP.

7. The system of claim 6, further comprising:

a first packer positioned nearer to a downhole end of the production tubing than an uphole end of the production tubing, the first packer configured to seal a portion of the wellbore at or below the downhole end of and outside the production tubing from an external portion of the production tubing above the downhole end; and a second packer positioned within the production tubing nearer to the downhole end than the uphole end, the well debris cutting tool positioned downhole of the second packer, the second packer configured to direct the well fluid to flow through the well debris cutting tool and block the well fluid from flowing through a remainder of an internal portion of the production tubing.

8. The system of claim 7, wherein the well debris cutting tool comprises:

a turbine configured to be positioned within the wellbore, downhole relative to the ESP, the turbine configured to rotate in response to flow of the well fluid through the turbine in the uphole direction, the turbine configured to counter-rotate relative to the ESP;

a first cutting blade sub-assembly connected to and rotatable by the turbine, the first cutting blade sub-assembly configured to grind the debris in response to being rotated by the turbine; and a second cutting blade sub-assembly connected to and rotatable by the ESP, the second cutting blade sub-assembly being uphole relative to the first cutting blade sub-assembly and downhole relative to the ESP, the second cutting blade sub-assembly configured to grind the debris in response to being rotated by the ESP.

9. A wellbore production system comprising:

a thru-tubing cable deployed electric submersible pump (CDESP) configured to be positioned within a wellbore using a production tubing, the CDESP configured to rotate to pump well fluid in an uphole direction;

a motor configured to be positioned within the wellbore uphole relative to the CDESP, the motor coupled to the CDESP and configured to provide power to rotate the CDESP; and a well debris cutting tool configured to be positioned within the wellbore downhole relative to the CDESP, the well debris cutting tool configured to counter-rotate relative to the CDESP, the well debris cutting tool configured to grind debris carried by the well fluid in the uphole direction, the well debris cutting tool comprising:

a turbine configured to be positioned within the wellbore, downhole relative to the CDESP, the turbine configured to rotate in response to flow of the well fluid through the turbine in the uphole direction, the turbine configured to counter-rotate relative to the CDESP;

a first cutting blade sub-assembly connected to and rotatable by the turbine, the first cutting blade sub-assembly configured to grind the debris in response to being rotated by the turbine; and a second cutting blade sub-assembly connected to and rotatable by the CDESP, the second cutting blade sub-assembly being uphole relative to the first cutting blade sub-assembly and downhole relative to the CDESP, the second cutting blade sub-assembly configured to grind the debris in response to being rotated by the CDESP.

10. The system of claim 9, further comprising a stinger coupled to and positioned downhole relative to the well debris cutting tool, the stinger configured to direct the well fluid to flow into the well debris cutting tool.

11. The system of claim 10, further comprising:

a packer positioned downhole relative to the well debris cutting tool, the packer configured to fluidically isolate a portion of the wellbore, downhole relative to the well debris cutting tool from a remainder of the wellbore, uphole relative to the well debris cutting tool; and a pod positioned downhole relative to the CDESP, the pod configured to couple to the stinger and the packer and to fluidically isolate an inner portion of the wellbore, uphole relative to the packer from a remaining outer portion of the wellbore, uphole relative to the packer.

12. The system of claim 11, further comprising:

a first protector configured to be positioned between the CDESP and the motor, the first protector configured to absorb a first portion of axial loads from the CDESP; and a second protector configured to be positioned between the well debris cutting tool and the CDESP, the second protector configured to absorb a second portion of axial loads from the debris cutting tool.

13. The system of claim 10, further comprising a packer positioned downhole relative to the well debris cutting tool, the packer configured to couple to the stinger and to fluidically isolate a portion of the wellbore, downhole relative to the well debris cutting tool from a remainder of the wellbore, uphole relative to the well debris cutting tool.

14. The system of claim 9, further comprising:

a first packer positioned nearer to a downhole end of the production tubing than an uphole end of the production tubing, the first packer configured to seal a portion of the wellbore at or below the downhole end of and outside the production tubing from an external portion of the production tubing above the downhole end; and a second packer positioned within the production tubing nearer to the downhole end than the uphole end, the well debris cutting tool positioned downhole of the second packer, the second packer configured to direct the well fluid to flow through the well debris cutting tool and block the well fluid from flowing through a remainder of an internal portion of the production tubing.

* * * * *